US007410321B1

(12) United States Patent
Schiefferly et al.

(10) Patent No.: US 7,410,321 B1
(45) **Date of Patent: *Aug. 12, 2008**

(54) MOBILE WORK ZONE PROTECTION DEVICE

(75) Inventors: Calvin W. Schiefferly, Elk Grove, CA (US); Angela E. Wheeler, Sacramento, CA (US); Jeremy M. Matsuo, Sacramento, CA (US)

(73) Assignee: State of California Department of Transportation, Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/586,847

(22) Filed: Oct. 24, 2006

Related U.S. Application Data

(63) Continuation of application No. 10/819,782, filed on Apr. 6, 2004, now Pat. No. 7,125,198.

(51) Int. Cl.
*B60R 21/00* (2006.01)
*E01F 15/00* (2006.01)

(52) U.S. Cl. ..... 404/6

(58) Field of Classification Search ..... 404/6; 293/133

See application file for complete search history.

(56) References Cited

U.S. PATENT DOCUMENTS 3,734,540 A 5/1973 Thiermann
4,240,647 A 12/1980 Lewis
4,385,771 A 5/1983 Eckels
4,600,178 A 7/1986 Zucker
4,624,601 A 11/1986 Quittner
5,007,763 A 4/1991 Burgett
5,088,874 A 2/1992 Quittner
5,101,927 A * 4/1992 Murtuza ..... 180/275
5,688,071 A 11/1997 Owen
5,947,452 A 9/1999 Albritton
6,098,767 A 8/2000 Unrath
6,213,047 B1 4/2001 Means
6,220,780 B1 4/2001 Schindler
6,231,065 B1 5/2001 Brown
6,450,522 B1 9/2002 Yamada
6,523,872 B2 2/2003 Breed
6,581,992 B1 6/2003 Gertz

OTHER PUBLICATIONS

W. Lynn Beason Engineering Research Associate/Hayes E. Ross, Jr.; Development of a Truck-Mounted Portable Maintenance Barrier; Research Report 262-5; Apr. 1984; 72 pages; Texas. Transportation Institute; College Station, TX.

* cited by examiner

*Primary Examiner*—Raymond W Addie
(74) *Attorney, Agent, or Firm*—Heisler & Associates

(57) ABSTRACT

A mobile work zone protection device includes a front carrier, a barrier beam assembly, and a rear carrier. In one embodiment, the barrier beam assembly includes two sets of telescoping beam structures. Each of these structures can rotate from one side of the device to the other, and thus can be deployed to create a safe work zone for roadway workers on either side of the device. The structure can also be left in the transit position to provide an enclosed safe work zone.

20 Claims, 12 Drawing Sheets

Fig. 14
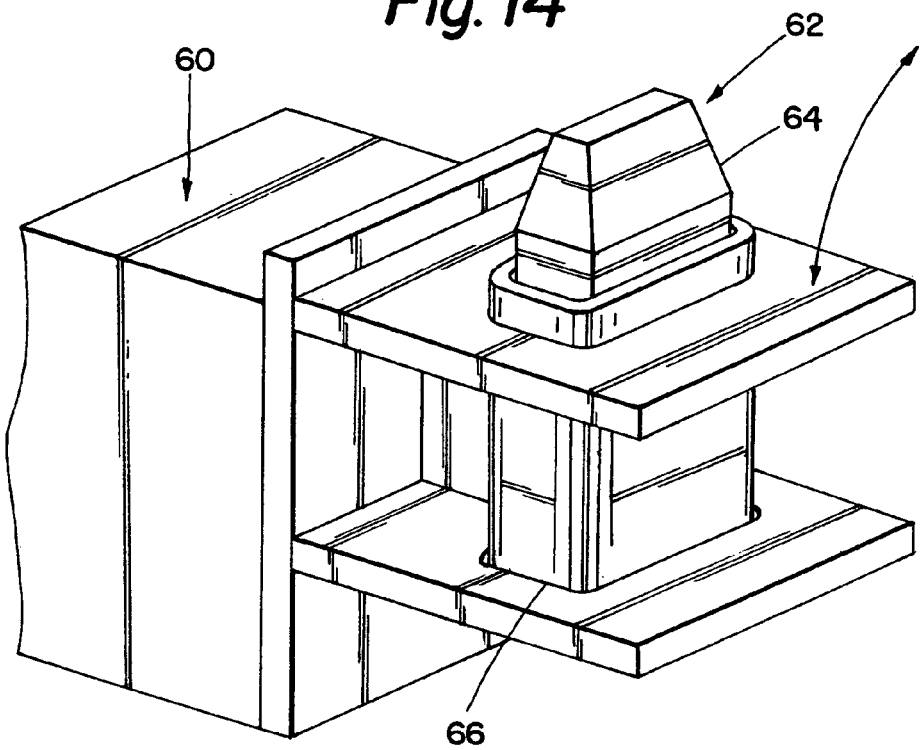
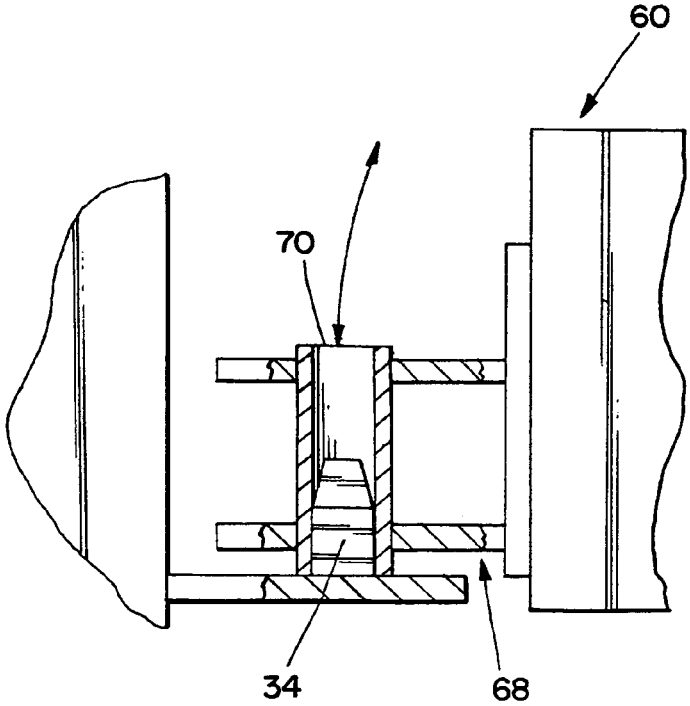
Fig. 15

MOBILE WORK ZONE PROTECTION DEVICE

CROSS-REFERENCE TO RELATED APPLICATIONS

This application is a continuation of U.S. patent application Ser. No. 10/819,782, filed on Apr. 6, 2004 (now U.S. Pat. No. 7,125,198).

FIELD OF THE INVENTION

This invention relates to devices for protection of workers performing maintenance and repairs on roadways.

BACKGROUND OF THE INVENTION

Each year, many highway maintenance workers are injured or killed by errant vehicles. For long term projects, concrete barriers can be installed to create a safe work area for highway workers. But for short term projects, it is impractical to use concrete barriers, so instead cones are sometimes used to protect the side portion of the work area, and a "shadow" vehicle is often used to protect the upstream or rear area.

But cones cannot stop errant vehicles that swerve into the work area, so there is a need for a mobile work zone protection device that can be deployed rapidly, and that can effectively protect workers from errant vehicles.

SUMMARY OF THE INVENTION

The present invention is a mobile work zone protection device, comprised of a truck, a front carrier, a barrier beam assembly, and a rear carrier.

BRIEF DESCRIPTION OF THE DRAWINGS

FIG. 14 is a perspective view of a beam end coupler with pin, according to an embodiment of the present invention.

FIG. 15 is a cross sectional side view of a beam end coupler without pin mating with a base pin.

DESCRIPTION OF THE PREFERRED EMBODIMENT

Figure 1:
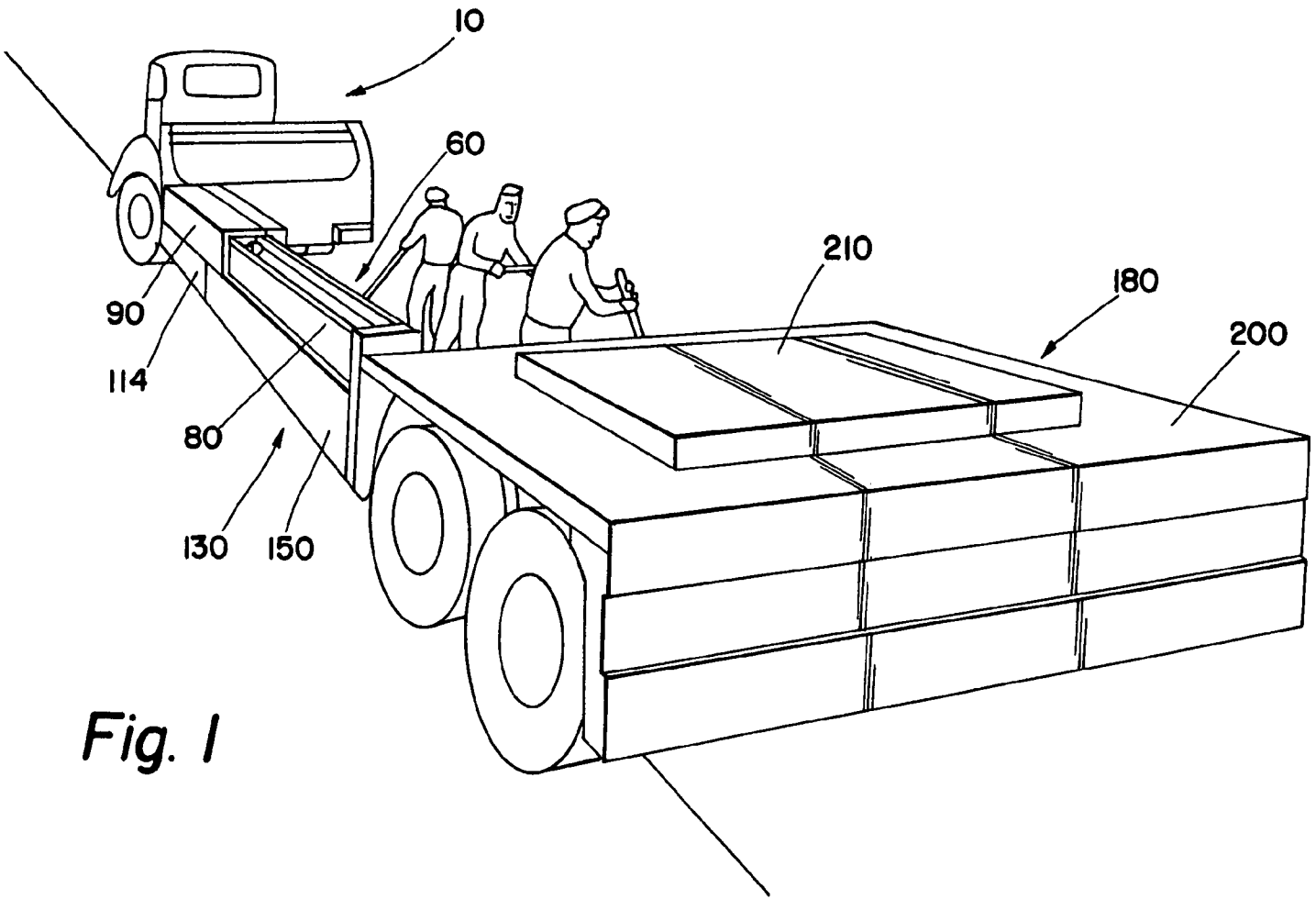
FIG. 1 is an environmental perspective view of a mobile work zone protection device according to an embodiment of the present invention.

The present invention is a mobile work zone protection device, comprised of a truck 10, a front carrier 20, a barrier beam assembly 40, and a rear carrier 180.

Truck

The truck 10 can be any virtually any tractor unit, with an engine (typically diesel), a driver's cab, and standard vehicle controls. The truck will have a standard "fifth wheel" 12 coupling device for removably attaching the truck 10 to the front carrier 20. See FIGS. 2, 3, and 10. The fifth wheel 12 will be slidable on tracks (not shown), so that it can be moved forward or backward.

To allow deployment of the barrier beam assembly 40, the truck 10 has a hydraulic power means and a pneumatic power means. As explained below, the present invention uses hydraulic power to deploy the barrier beam assembly, and it uses air controls to lock the assembly. In this embodiment hydraulic power is provided by the truck engine using a PTO, but can also be provided by an independent or alternative engine with a pump installed. Air is supplied by the air brake system compressor, but can be provided by an independent or alternative compressor.

Figure 10:
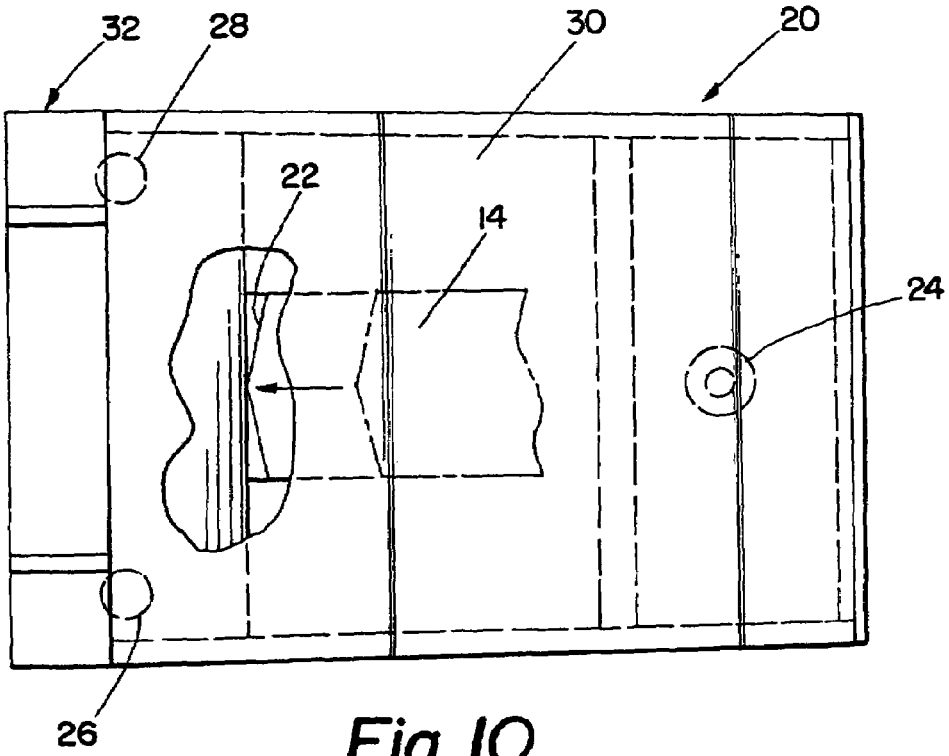
FIG. 10 is a top view showing the "V" shaped cross member of the truck as it mates with the "V" shaped coupler of the front carrier.
Figure 11:
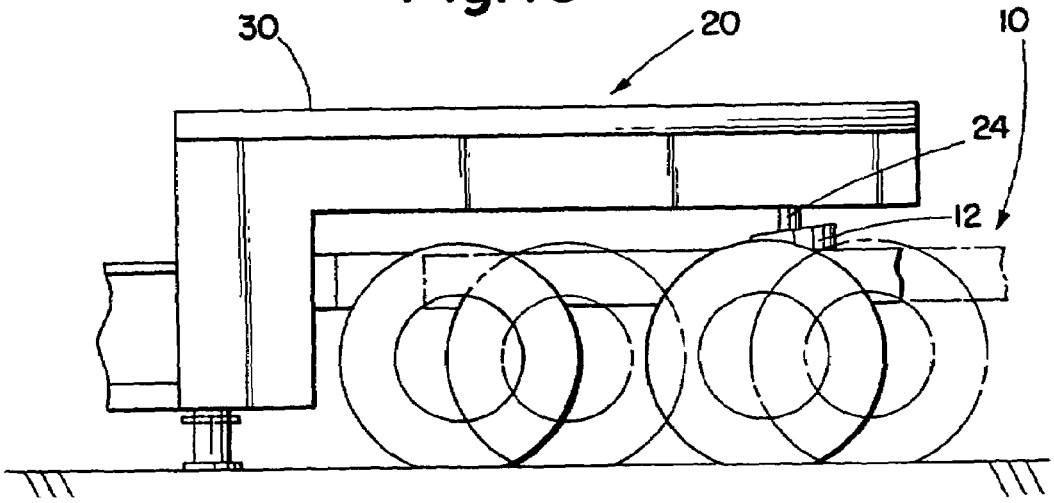
FIG. 11 is side view showing the front carrier as it mates with the truck.

The truck 10 is modified so that it can be locked into non-pivoting alignment with the front carrier 20. See FIGS. 2, 3, 10 and 11. In one embodiment, as shown in FIG. 10, the rear cross member of the truck 10 can be modified into a "V" shaped cross member 14. This modified cross member 14 can then mate with a corresponding "V" shaped coupler 22 on the front carrier 20. When so mated, the front carrier 20 is locked with the truck 10. This will prevent the truck 10 from pivoting or "jackknifing" if the barrier beam assembly 40 is struck by an errant vehicle, and also provides greater protection for the workers.

Front Carrier

The front carrier 20 is removably attached to the truck 10 by means of a standard kingpin 24 that fits into the fifth wheel 12. When the device is traveling, the fifth wheel 12 is positioned on its tracks so as to create sufficient distance between the "V" shaped cross member 14 and the "V" shaped coupler 22 so that the truck 10 can turn without hindrance. See FIG. 2.

The front carrier 20 helps support the barrier beam assembly 40. It may follow the "L" shaped design shown in FIGS. 2 and 3, or it may have a "gooseneck" shape, or any other shape that will allow it to fulfill its function.

Figure 2:
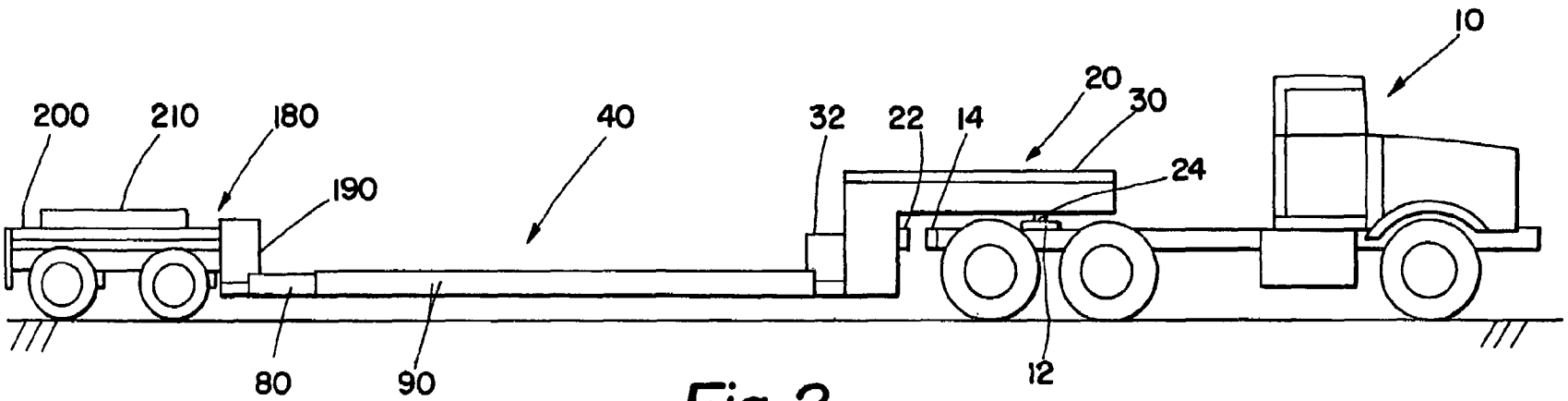
FIG. 2 is a side view of a mobile work zone protection device according to an embodiment of the present invention, shown in its transit mode.
Figure 3:
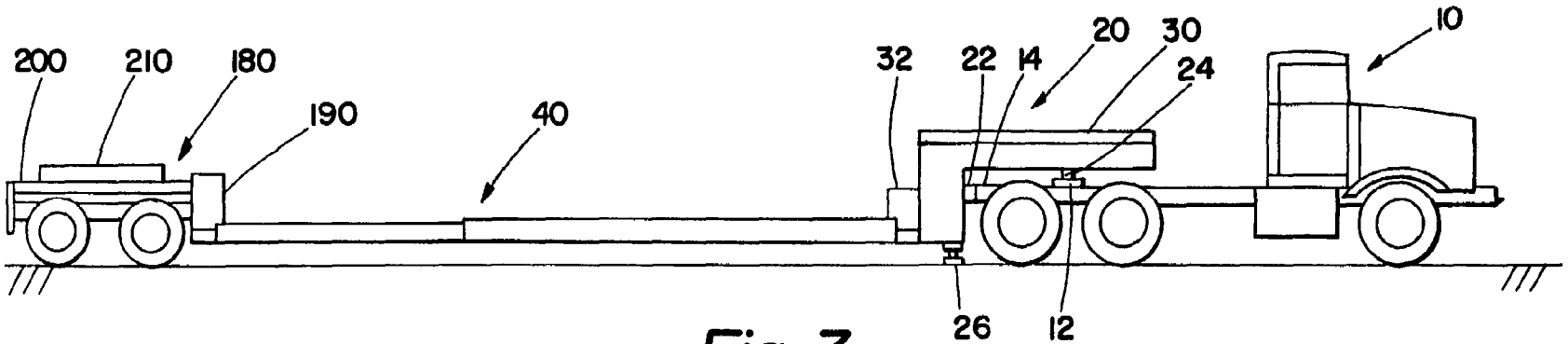
FIG. 3 is a side view of a mobile work zone protection device according to an embodiment of the present invention, depicted after the jacks have been lowered, the front carrier has been non-pivotably mated with the truck, and the barrier beam assembly has been extended.

As shown in FIGS. 3, 10, 11, and 18, the front carrier 20 has jacks 26, 28, which are sometimes referred to as "landing gear." In one embodiment, these jacks 26, 28 are hydraulically powered and can raise or lower the front carrier 20 and hence the barrier beam assembly 40. Each jack can be operated independently, so that they can level the barrier beam assembly 40 on slanted surfaces. These jacks 26, 28 also improve the device's stability when deployed. These jacks are retracted when the device is in transit, as shown in FIG. 2. Jacks could also be added to the rear carrier.

The front carrier 20 also may have a front deck area 30, and straps or fastening means may be provided with the deck area for carrying cargo. See FIGS. 2 & 3. Ballast could also be placed on the front deck area 30 for added mass.

Barrier Beam Assembly

The barrier beam assembly 40 is the section of the device intermediate between the front carrier 20 and the rear carrier 180. It includes two actuator housings 32, 190, two front arms 42, 44, two rear arms 50, 52, and two beam structures 60, 130. See FIGS. 4, 5.

The actuator housings 32, 190 are adjacent to the front carrier 20 and rear carrier. See FIGS. 2, 3, 4, 5, 6. Each of these housings contains an actuator, and the actuators drive the arms 42, 44, 50, 52 that move the beam structures 60, 130. See FIGS. 1, 2, 3, 4, 5, 6, 7, 8, 14, 15, 16, 17, 19. In one embodiment, the actuators have a hydraulically-powered rack and pinion. Hydraulic hoses extend from the hydraulic power source in the truck to both the front and rear actuator.

Each of the two front arms (42 or 44) is attached to one of the beam structures (60 or 130). See FIGS. 4, 5, 6, 7, and 8. The arms 42, 44, 50, 52 allow for 180 degree movement of the beam structures 60, 130, so that each beam structure can be deployed on either the left side or the right side of the device, as shown on FIGS. 4, 5, 7, and 8. Beam structures 60, 130 may also be left in the transit position to provide a work zone that is protected on both the right and left side for work to be done in a lane between traffic.

The rear arms 50, 52 are analogous to the front arms 42, 44, except that they are placed on the rear carrier 180. Spacers 46, 48, 49 may be placed adjacent to both the front and rear arms 42, 44, 50, 52. See FIGS. 6, 19A.

Figure 20:
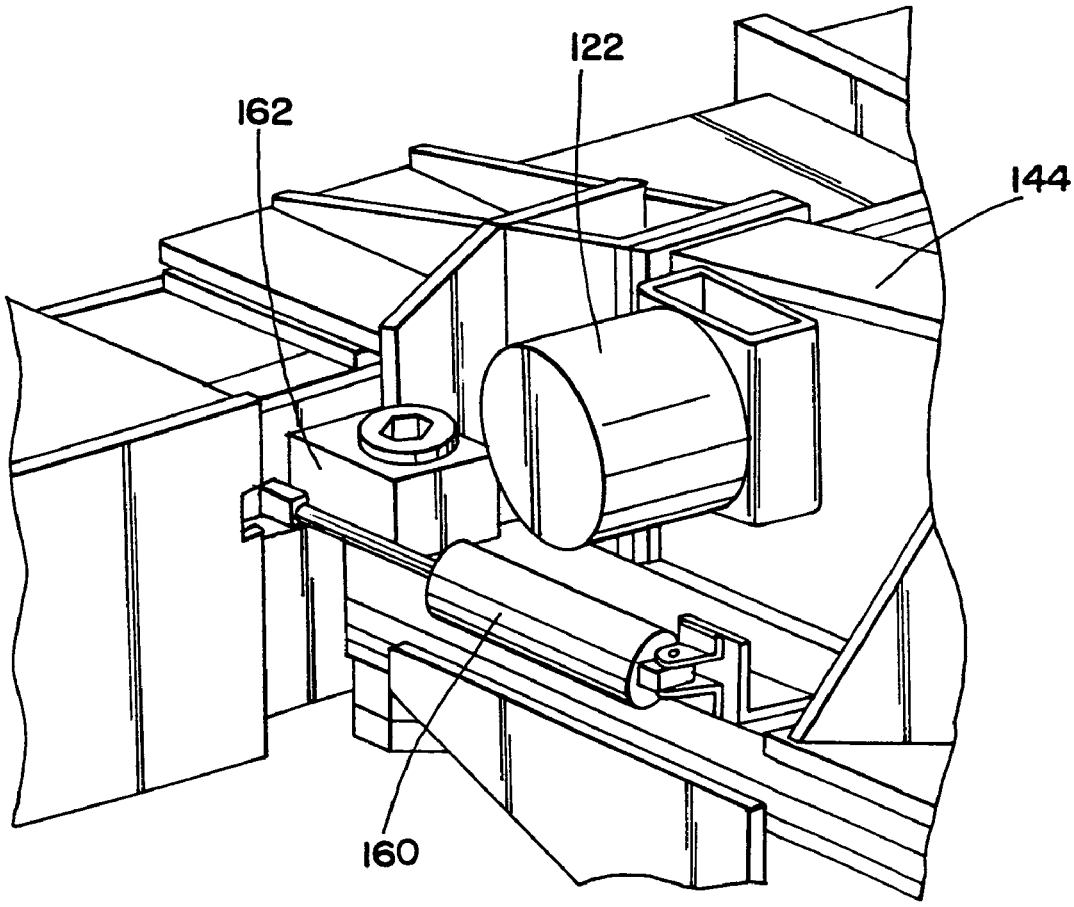
FIG. 20 is a perspective view of a rotational lock assembly according to an embodiment of the present invention.

In the embodiment shown in the figures, each longitudinal pair of arms (i.e. 42 & 50, 44 & 52) is separately powered, and thus each beam structure 60, 130 can move independently of the other. See FIGS. 7 & 8. In another embodiment, only one pair of arms is powered, and the other pairs of arms and their attached beam structure can be moved by attachment to the powered arms. When only one pair of arms is powered, a beam pickup lock 122 may be used in conjunction with a beam pickup lock socket 124 to lock the two beam structures 60, 130 to each other, so that the beam structure attached to the powered arms can pull or push the beam structure that it is not attached to the powered arms. See FIGS. 6, 19, 20.

Figure 8:
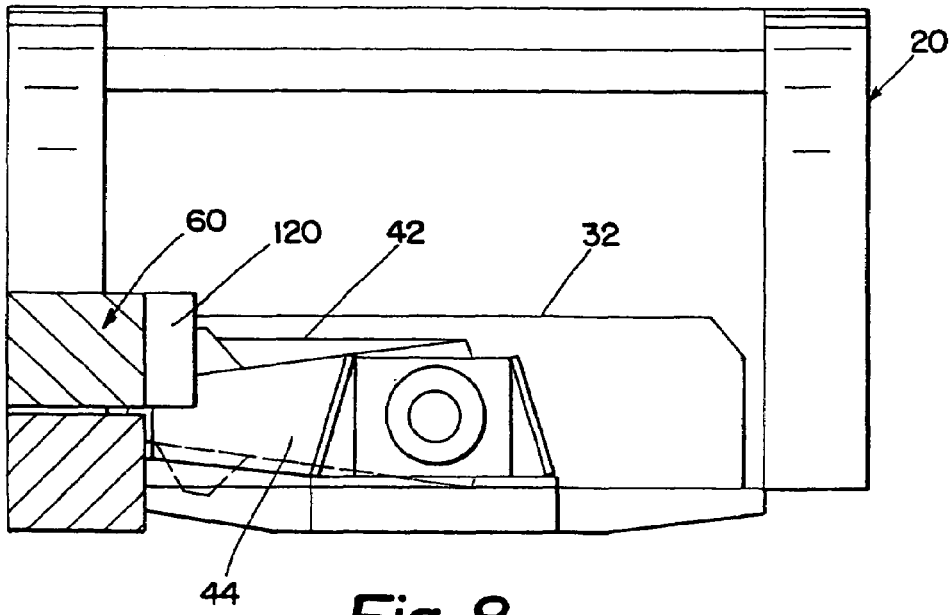
FIG. 8 is a front sectional view of a barrier beam assembly according to an embodiment of the present invention, with both beam structures on the same side, as they would typically be when the device is deployed.

Each beam structure 60, 130 has beam end couplers at each end of the beam structure. See FIGS., 6, 12, 13, 14, and 15. Thus, in FIG. 6, one beam end coupler 62 is part of the first beam structure 60, and the second beam end coupler 134 is part of the second beam structure 130. These beam end couplers help lock the beam structures to each other when one is placed atop the other, as shown in FIGS. 1 and 8.

Figure 12:
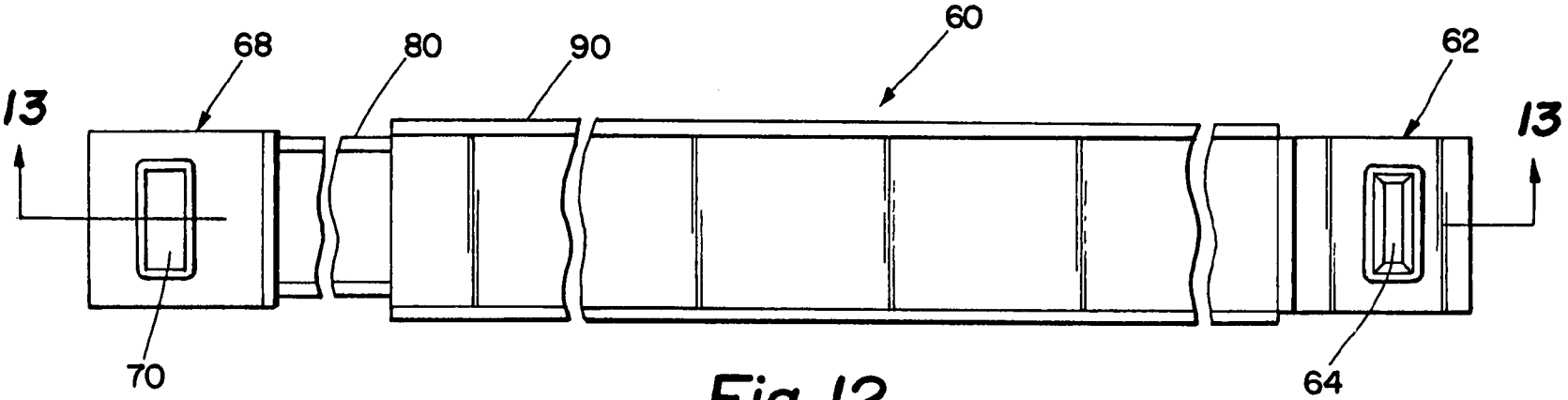
FIG. 12 is a top view of a beam structure according to an embodiment of the present invention.
Figure 13:
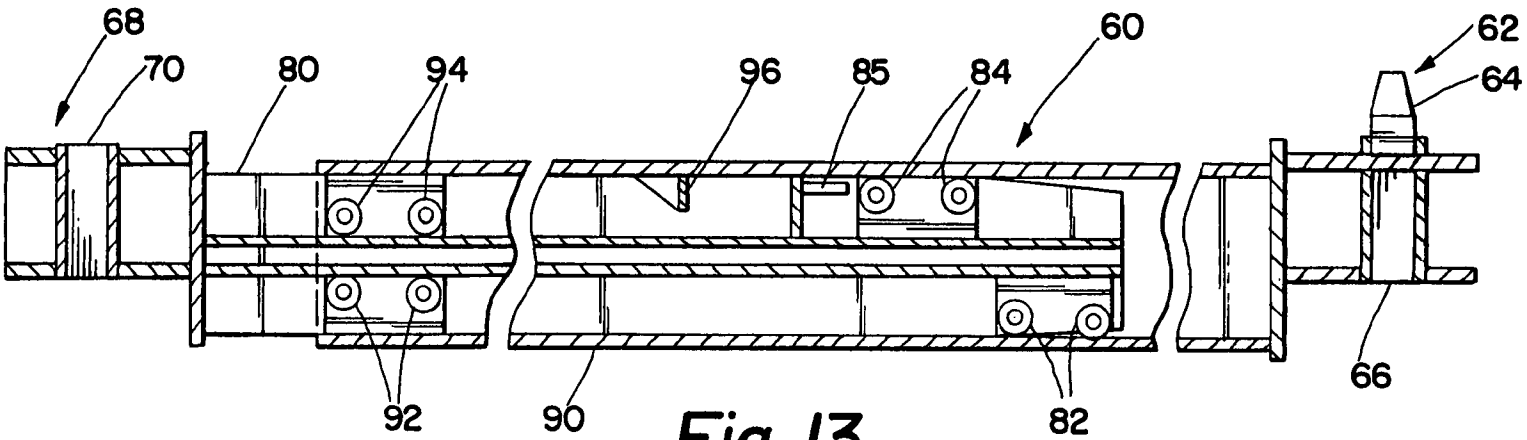
FIG. 13 is a cross sectional view of the beam structure depicted in FIG. 12, taken along line 13-13 of FIG. 12.
Figure 16:
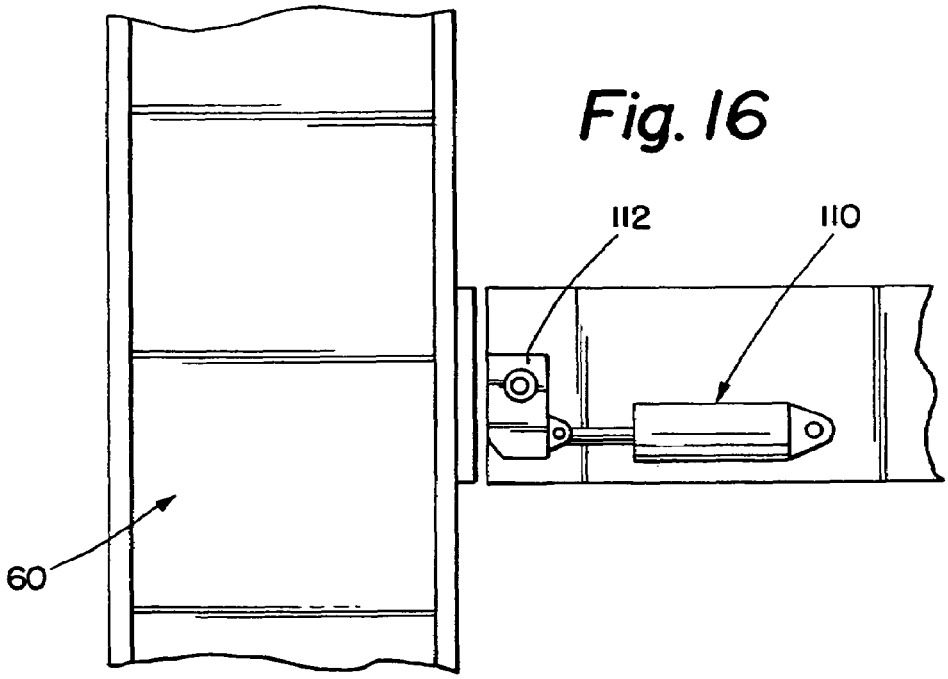
FIG. 16 is a top view of a beam structure according to an embodiment of the present invention, showing a rotational lock in its unlocked position.
Figure 17:
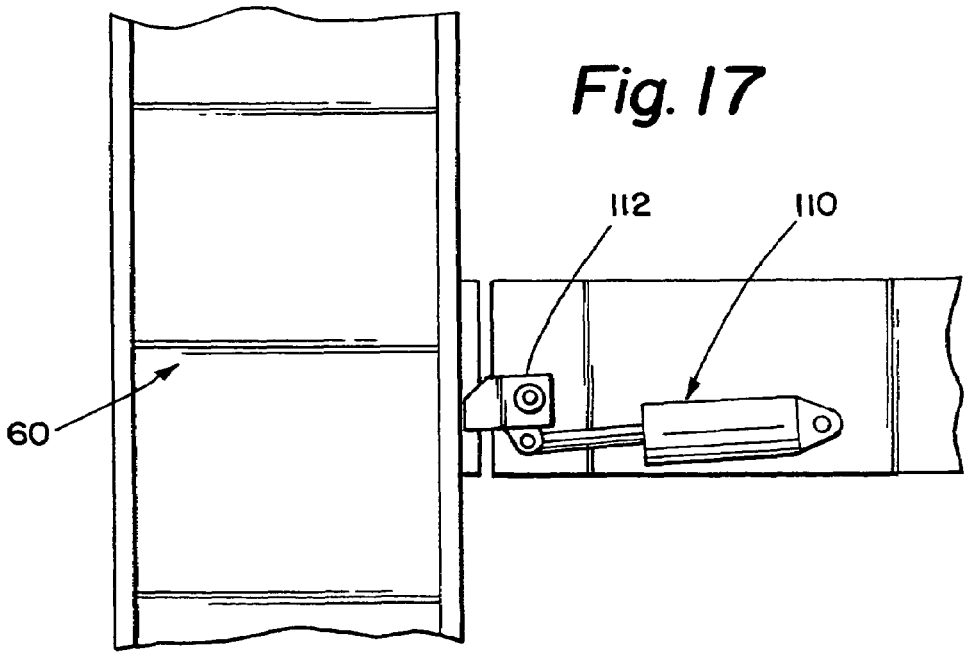
FIG. 17 depicts the same rotational lock as shown in FIG. 12, with the rotational lock moved from its unlocked to its locked position.
Figure 18:
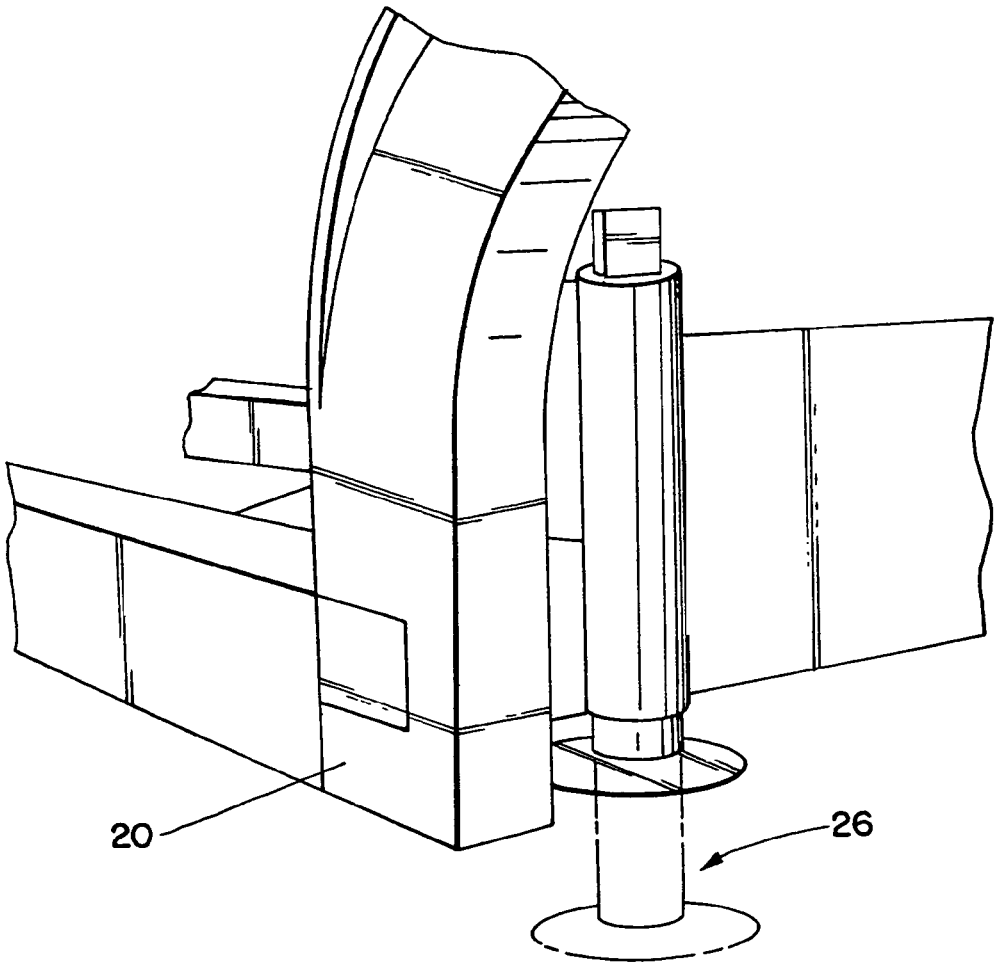
FIG. 18 shows a jack in the front carrier of a work zone protection device according to an embodiment of the present invention.
Figure 19:
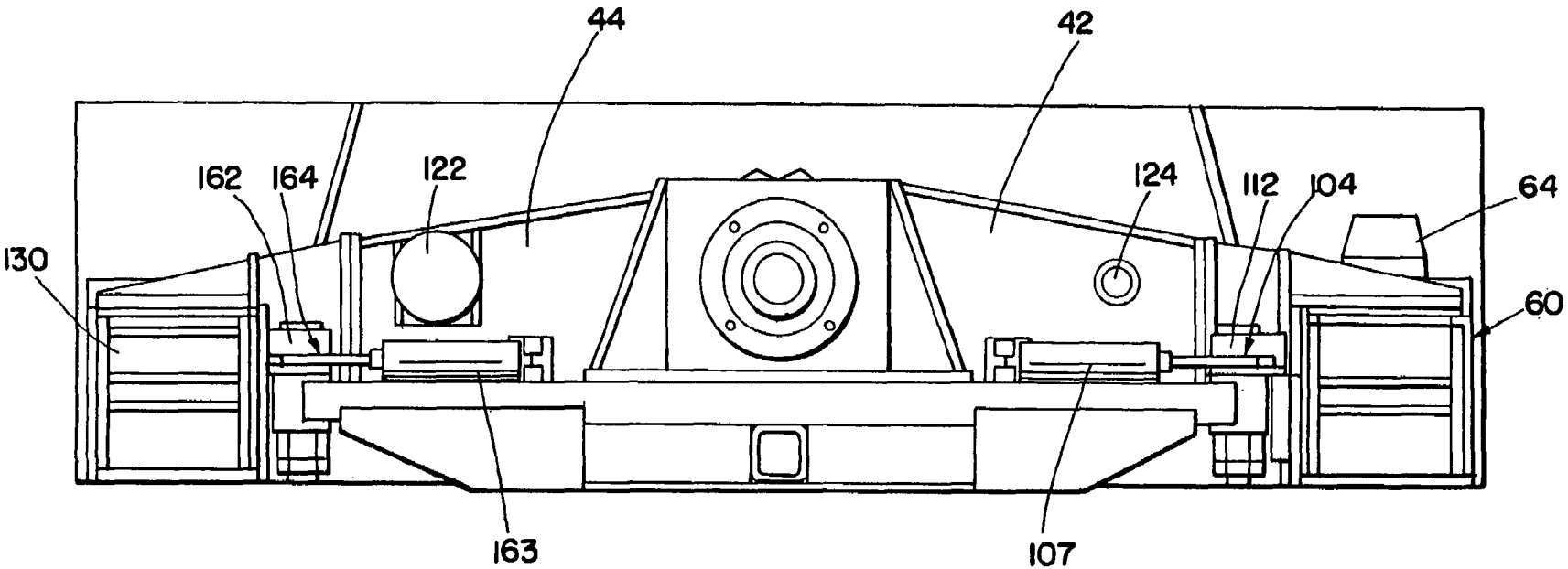
FIG. 19 is a front view of the front portion of a barrier beam assembly according to an embodiment of the present invention.

There are two type of beam end couplers: beam end couplers with pins 62 and beam end couplers without pins, 68. As shown in FIGS. 12, 13, 14, a beam end coupler with a pin 62 has a pin 64 and a receiving socket 66. As shown in FIG. 12, 13, 15, a beam end coupler without a pin 68 only has receiving socket 70. Each beam structure 60, 130 has one of each kind of each beam end coupler, so that the two beam structures can mate together, with the pin of one beam end coupler joining with the receiving socket of the other beam end coupler without a pin.

Figure 4:
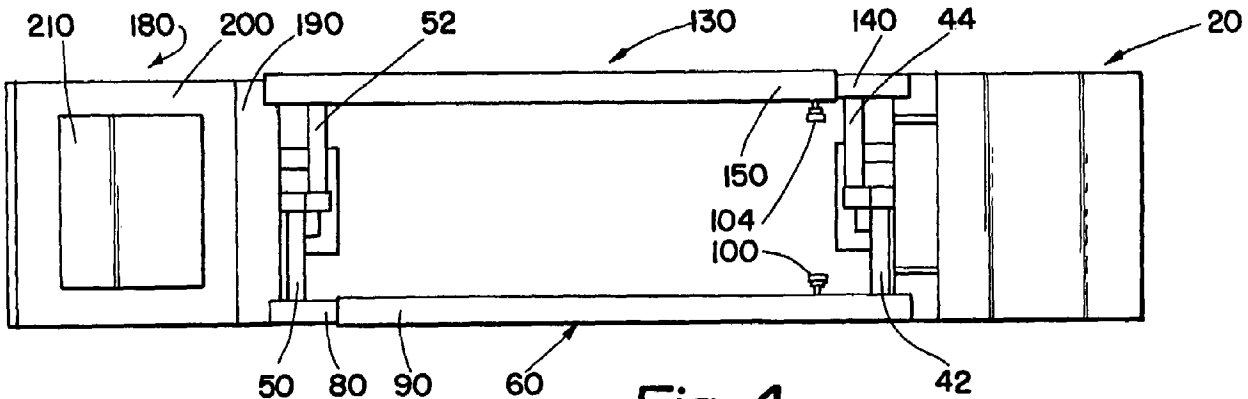
FIG. 4 is a top view of a mobile work zone protection device according to an embodiment of the present invention, shown in transit mode.

When the two beam structures 60, 130 are not joined together, as in FIG. 4, then a receiving socket for each beam end coupler is engaged to a base pin 34, as shown in FIG. 15. Thus, there are four base pins, two on the rear carrier, and two on the front carrier.

The first beam structure 60 includes a beam 80 that is extendable by telescoping in and out of a box tube assembly 90. See FIGS. 1, 4, 5, 6 12, and 13, More particularly, when the beam 80 is fully retracted within the box tube assembly 90, the device is shortened, and ready for transit. See FIG. 2. When deployed, the beam 80 is pulled out of the box tube assembly 90, thereby creating a safe work area of maximum size. In one embodiment, this work area is approximately 30 feet long. By telescoping or extending the barrier beam assembly 40, the device can be short enough for highway transportation without special permits, yet can provide a work area of sufficient size.

The beam 80 telescopes in and out of the box tube assembly 90 by rolling on wheels 82, 84, 92, and 94. Wheels are provided on the beam 82, 84 and on the box tube assembly 92, 94. See FIG. 13. Although only one beam structure is shown in FIG. 13, the other beam structure has the same wheel assembly and the same system for telescoping. If rollers or wheels are not used, then other common methods of friction reduction may be utilized, such as nylon or UHMW plastics, lubrication with oils or grease, or the use of a slide with or without bearings.

The second beam structure 130 is the same as the first beam structure 60, in that it has a beam 140 and a box tube assembly 150. The beam structures 60, 130 may be installed in opposite directions, i.e. the beam 80 of the first beam structure 60 may sit atop the box tube assembly 150 of the second beam structure 130 when the device is deployed, although other configurations can be used. See FIG. 1.

Other systems could be used in lieu of the telescoping to achieve extending effect.

Extension or telescoping of the beam structure 60, 130 is accomplished by setting the brakes on the rear carrier 180, and driving the truck 10 forward, until the stops 85, 96 incorporated into the beam structure 60, 130 prevent further extension See FIG. 13. Retraction of the beam structures is the reverse of extension.

Figure 6:
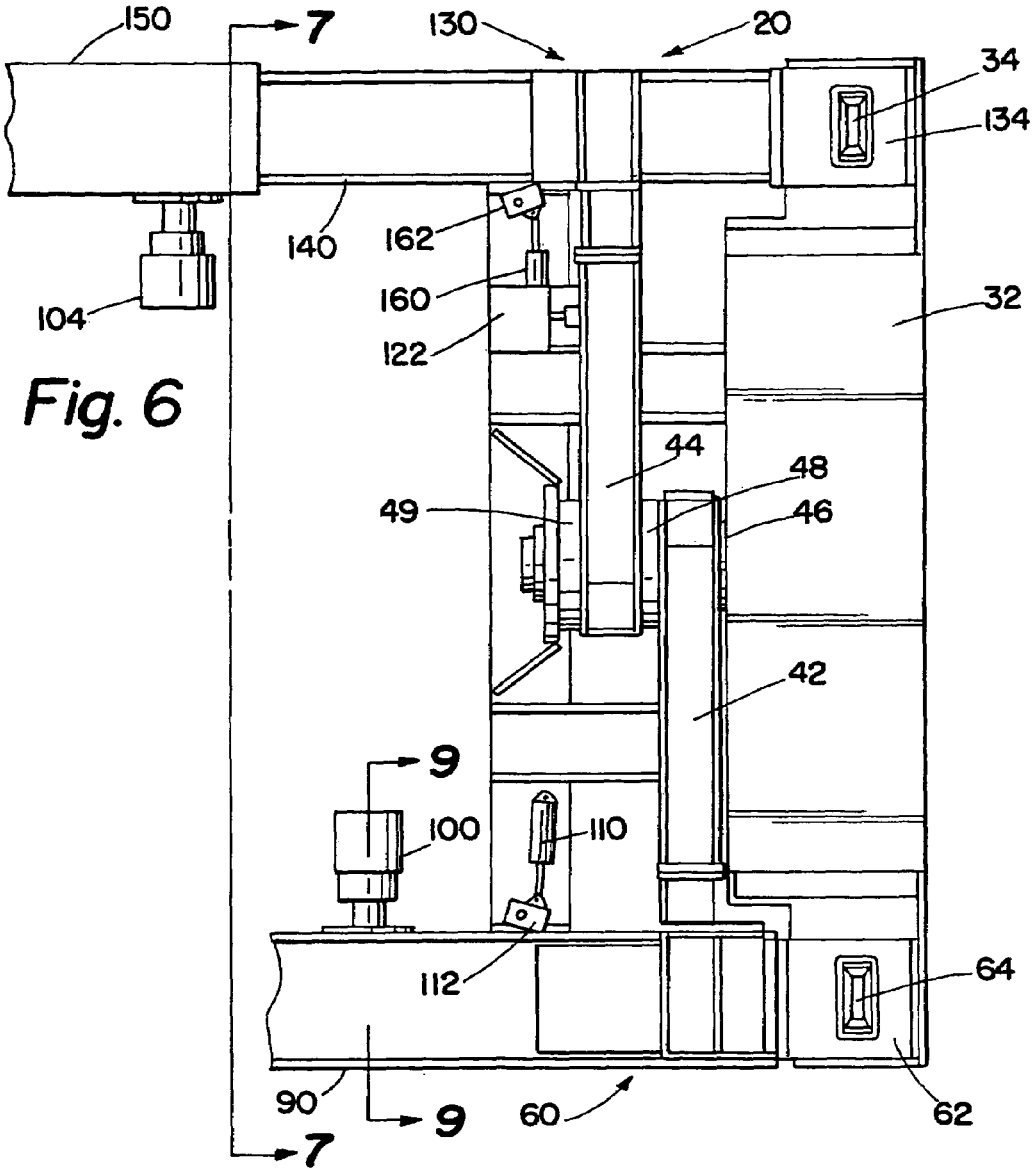
FIG. 6 is a top view of the front portion of a barrier beam assembly according to an embodiment of the present invention.
Figure 9:
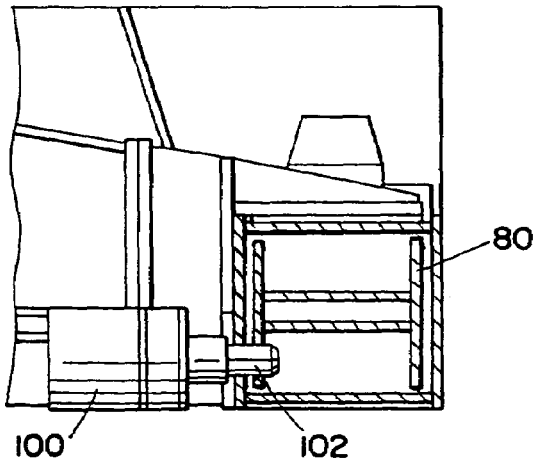
FIG. 9 is a cross sectional view taken along line 9-9 of FIG. 6.

Each beam structure 60, 130 may have a retraction lock 100 to lock the beam structure in its retracted position for transit, as shown in FIGS. 6 and 9. As shown in FIG. 9, the retraction lock 100 has a retraction lock pin 102 that fits into a slot in the beam 80. In one embodiment, these retraction locks are pneumatically powered.

The beam structures may also have a combination retraction/extension lock 104, that can both lock a beam structure in its retracted state and in its extended state. See FIGS. 4 and 6. The combination retraction/extension lock 104 operates essentially the same as the retraction lock 100. See FIG. 9. Separate extension lock could also be used in lieu of the combination retraction/extension lock.

Rotational locks 110, 160 are provided at the front end of each beam structure 60, 130. They also may be provided on the rear (not shown). When activated, locking blocks 112, 162 on these structures rotate to hold down the beam structures 60, 130, to add rigidity to the structures, and to take some stress off the arms 42, 44, 50, 52. See FIGS. 6, 16, 17, 19, 20.

Figure 7:
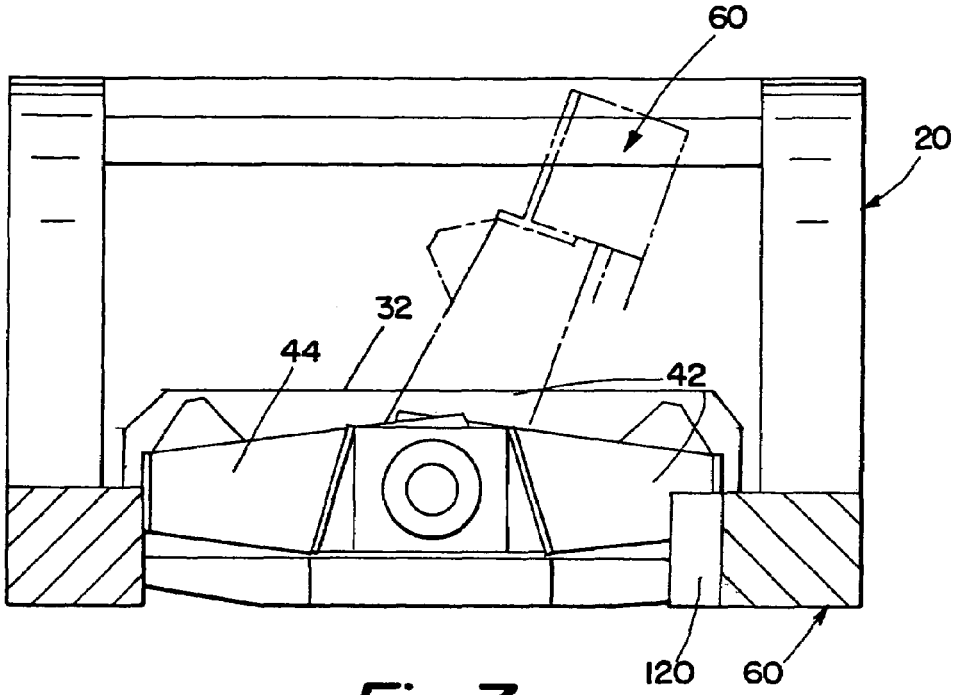
FIG. 7 is a front sectional view of a barrier beam assembly according to an embodiment of the present invention, with a beam structure moving from one side to the other.

As shown in FIGS. 7, 8, one of the beam structures has cable housing 120, into which the hydraulic, pneumatic, and electrical cables for the rear carrier are housed. A conduit such as the "energy chain" from Igus, Inc. of Providence, R.I. may be used with the cable housing 120 to help prevent bunching or tangling.

Figure 5:
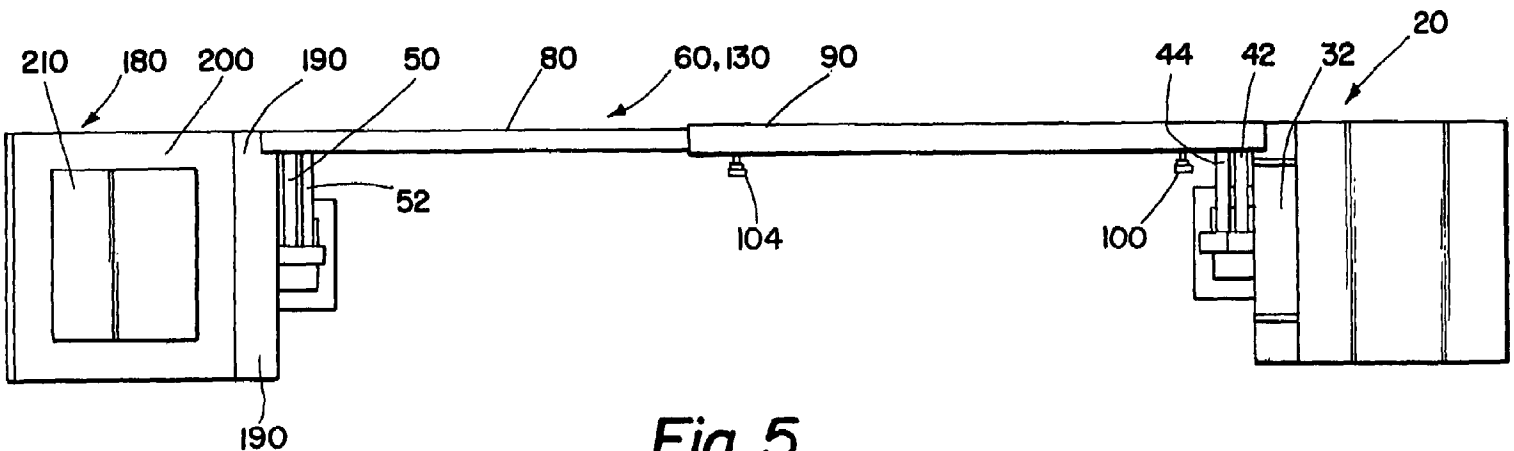
FIG. 5 is a top view of a mobile work zone protection device according to an embodiment of the present invention, shown in deployed mode.

The outer surface of the beam structures can be substantially planar, as shown in FIGS. 1, 4, and 5, or they can be tapered, similar to the taper in a "Jersey Wall" type of concrete barrier.

There are a number of different ways to deploy the barrier beam assembly besides the arms described above. For instance, a small crane could be used to lift and move the beams from side to side. Or a single beam or a set of beams could fit into horizontal tracks on the front and rear carrier, and the beam or beams could slide from the left side to the right side, depending on where they are needed. For transit, the beam or beams could be locked into the center of the tracks. Or the beam can be made for one side operation only, but when the opposite side is needed, the towing ends could be swapped before traveling to the work location.

In the embodiment presented in the illustrations, two beam structures are provided. When the device is in transit, one beam is placed on each side. When the device is deployed on site, both beams are placed on the same side, namely the side closest to traffic. It can be left in the transit position for both left and right protection for center lane deployment The workers then have a safe work area with the zone between the front carrier, the rear carrier, and the beam structures. The beam structures provides protection against vehicles of various sizes, from low-to-the-ground subcompacts to high-clearance trucks.

Rear Carrier

The rear carrier 180 provides support for the beam structures 60, 130, as well as the rear actuator housing 190 and rear arms 50, 52. See FIGS. 1, 2, 3, 4, and 5. The rear carrier 180 also may include a deck 200, and ballast 210 can be placed in the rear carrier for extra weight. See FIGS. 1, 2, 3.

Operation

In operation, the device can be readied for transit by positioning the beam structures 60, 130 so that one is on the left, and one is on the right. The beam structures 60, 130 are then locked into placed, by activating the retraction lock 100 (and/or the retraction/extension lock 104) and the rotational lock (s) 110. The fifth wheel 12 is positioned so that there is sufficient space between tractor unit 10 and the front carrier 20 to allow complete freedom for turning.

The device is then driven to the work site, and is prepared for deployment. Since the beam structures 60, 130 can be deployed on either side, the present invention can easily be used to create a safe work area on either the side of the road, the median, or within lanes of traffic.

The united beam structure can then be extended, by locking the brakes on the rear carrier, and driving the truck forward until the stop plate 96 is engaged.

Once the vehicle parks at the work area, the jacks 26, 28 or "landing gear" are lowered to stabilize the device for deployment. The air locks (retraction, retraction/extension, and rotational) are released, and the beam structure that is distal from the traffic is rotated approximately 180 degrees so that it sits atop the other beam structure. The beam end couplers then mate with each other, and the beams structure are united to form a single worker protection barrier beam.

In the embodiment shown in the figures, the device is designed to provide the best protection when both beam structures are united to form a single barrier beam structure. However, simply by extending the height of each beam structure, an alternative embodiment could be created in which each beam structure alone can provide as much protection as the unified barrier beam structure of FIG. 1.

Deployment of the device can be "manual," in the sense that the operator uses hydraulic and pneumatic control to lower the jacks, unlock the air locks, rotate the beam structures, extend the beam structures, and then relock the rotational air locks 110. The process could also be made automated with circuitry, so that the entire deployment sequence could be accomplished by pressing a single button. Also, deployment could be controlled by using remote control placed in the cab of the truck 10.

The device of the present invention can "creep" along in its deployed mode as workers perform their duties, thereby saving time that would otherwise be spent in setting up and taking down the structure.

Typically, the present invention would be used with one or two other vehicles, namely a work vehicle that contains needed equipment etc., and a "shadow" vehicle that would be parked upstream of the protected work zone to provided added safety. An attenuator can be added to the rear of the shadow vehicle. If no shadow vehicle is used, an attenuator can be added to the rear carrier.

One skilled in the art will appreciate that the present invention can be practiced by other than the preferred embodiments, which are presented for purposes of illustration and not of limitation.

What is claimed is:

1. A mobile work zone protection device for protecting roadway workers from errant traffic, the device comprising in combination:

an elongate first barrier extending substantially horizontally from a first end to a second end;

said first end coupled to a front carrier;

said second end coupled to a rear carrier, said rear carrier separate from said front carrier;

said elongate first barrier spaced laterally from a horizontal centerline passing through said first carrier and said second carrier;

said front carrier and said rear carrier adapted to preclude relative rotation therebetween about a vertical axis; and an at least partially open work zone between said front carrier and said rear carrier and lateral to said first elongate barrier, said work zone including said centerline passing therethrough.

2. The device of claim 1 wherein said elongate first barrier is adapted to be moved from a left side of said work zone to a right side of said work zone.

3. The device of claim 2 wherein said first end of said elongate first barrier is rotatably coupled to said front carrier and said second end of said elongate first barrier is rotatably coupled to said rear carrier, said elongate first barrier adapted to rotate about a rotational axis extending between said front carrier and said rear carrier.

4. The device of claim 3 wherein said rotational axis of said elongate first barrier is near said centerline of said work zone and substantially parallel with said centerline, with said elongate first barrier offset from said rotational axis by a distance similar to half of a width of said work zone, such that said elongate first barrier is located at a lateral perimeter of said work zone when said elongate first barrier is in either a left position adjacent said left side or a right position adjacent said right side.

5. The device of claim 1 wherein an elongate second barrier is provided, said elongate second barrier having a first end coupled to said front carrier and a second end coupled to said rear carrier.

6. The device of claim 5 wherein said elongate second barrier is adapted to be positioned independently of said elongate first barrier.

7. The device of claim 6 wherein each said elongate barrier is adapted to be moved from a left side of said work zone to a right side of said work zone while remaining coupled to said front carrier and said rear carrier.

8. The device of claim 1 wherein said elongate first barrier is substantially linear and adapted to extend in length linearly between said first end and said second end.

9. The device of claim 1 wherein a vehicle is provided removably coupleable to said front carrier, said vehicle having wheels and an engine adapted to drive said wheels, said vehicle adapted to move said front carrier, said rear carrier and said elongate first barrier together for deployment at a work site.

10. The device of claim 1 wherein said front carrier includes wheels, an engine adapted to drive said wheels and operator controls adapted to allow the mobile work zone protection device to be transported on a road to a work location.

11. A mobile work zone protection device for protection of workers, such as from errant traffic along a roadway, the device comprising in combination:

a first barrier having a first end opposite a second end;

said first barrier having a longitudinal axis extending substantially horizontally between said first end and said second end;

a front carrier coupled to said first end;

said front carrier adapted to support said first end of said first barrier without rotation between said front carrier and said first barrier about a vertical axis;

a rear carrier coupled to said second end;

said rear carrier adapted to support said second end of said first barrier without rotation between said rear carrier and said first barrier about a vertical axis;

said first barrier spaced laterally from a centerline extending from a center of said front carrier to a center of said rear carrier; and an at least partially open work zone between said front carrier and said rear carrier and lateral to said first barrier.

12. The protection device of claim 11 wherein said first barrier has a bottom edge low enough to substantially preclude low to the ground subcompact or sports car vehicles from entering said work zone, and a top edge high enough to substantially preclude high clearance vehicles from entering said work zone.

13. The protection device of claim 11 wherein a second barrier is provided similar to said first barrier, said second barrier and said first barrier independently positionable relative to each other on either side of said centerline.

14. The protection device of claim 13 wherein said first barrier and said second barrier are positionable both together on a common side of said centerline and separate from each other on opposite sides of said centerline.

15. The protection device of claim 11 wherein said first barrier is adapted to be extended in length with said front carrier and said rear carrier extended in distance from each other and said work zone increased in length between said front carrier and said rear carrier.

16. The protection device of claim 11 wherein a vehicle is provided removably coupleable to said front carrier, said vehicle having wheels and an engine adapted to drive said wheels, said vehicle adapted to move said front carrier, said rear carrier and said elongate first barrier together for deployment at a work site.

17. The protection device of claim 11 wherein said front carrier includes wheels, an engine adapted to drive said wheels and operator controls adapted to allow the mobile work zone protection device to be transported on a road to a work location.

18. The protection device of claim 11 wherein said first end and said second end of said first barrier are removably coupled to said front carrier and said rear carrier.

19. The protection device of claim 11 wherein said first end and said second end of said first barrier are movably attached to said front carrier and said rear carrier.

20. A work zone protection device for protecting roadway workers from errant traffic, the device comprising in combination:

an elongate first barrier extending substantially horizontally from a first end to a second end;

said first end coupled to a front carrier;

said second end coupled to a rear carrier, said rear carrier separate from said front carrier;

said first elongate barrier oriented spaced laterally from a horizontal centerline passing through said first carrier and said second carrier;

an at least partially open work zone between said front carrier and said rear carrier and lateral to said first elongate barrier, said work zone including said centerline passing therethrough; and said first elongate barrier adapted to preclude lateral vehicle incursion into said work zone by forming said barrier to have a top edge high enough to substantially preclude high clearance vehicles from entering said work zone, and a bottom edge low enough to substantially preclude low to the ground subcompact or sports car vehicles from entering said work zone.

* * * * *